United States Patent [19]

Turner, Jr.

[11] Patent Number: 4,656,937

[45] Date of Patent: Apr. 14, 1987

[54] TRASH COMPACTOR

[75] Inventor: John W. Turner, Jr., Houston, Tex.

[73] Assignee: International Tool and Supply Company, Inc., Houston, Tex.

[21] Appl. No.: 796,878

[22] Filed: Nov. 12, 1985

[51] Int. Cl.[4] ..... B30B 15/04

[52] U.S. Cl. ..... 100/100; 100/218; 100/229 A; 100/255

[58] Field of Search ..... 100/229 A, 100, 255, 100/53, 231, 218, 229 R

[56] References Cited

U.S. PATENT DOCUMENTS

| | | | |
|---|---|---|---|
| 626,727 | 6/1899 | Shepherd | 100/229 R |
| 3,556,619 | 1/1971 | Bottas et al. | 312/31 |
| 3,589,277 | 6/1971 | Gray | 100/229 A X |
| 3,608,476 | 9/1971 | Price et al. | 100/35 |
| 3,636,862 | 1/1972 | Bottas et al. | 100/45 |
| 3,734,006 | 5/1973 | Hennells | 100/53 |
| 3,800,694 | 4/1974 | Miller et al. | 100/45 |
| 3,808,967 | 5/1974 | Fair et al. | 100/221 |
| 3,831,513 | 8/1974 | Tashman | 100/52 |
| 3,862,595 | 1/1975 | Longo | 100/229 A X |
| 3,869,978 | 3/1975 | Steinberg et al. | 100/53 |
| 3,937,355 | 2/1976 | Engebresten | 220/63 |
| 4,008,658 | 2/1977 | Stock | 100/229 R |
| 4,212,240 | 7/1980 | Lee et al. | 100/52 |
| 4,492,156 | 1/1985 | Zimmer | 100/229 R |

FOREIGN PATENT DOCUMENTS

| | | | |
|---|---|---|---|
| 421060 | 5/1947 | Italy . | |
| 537299 | 12/1955 | Italy | 100/231 |
| 2109299 | 6/1983 | United Kingdom | 100/231 |

*Primary Examiner*—Billy J. Wilhite

*Attorney, Agent, or Firm*—Arnold, White & Durkee

[57] ABSTRACT

A compact, heavy duty trash compactor is provided for compacting trash in locations where space is limited. The compactor includes a C-shaped frame mounted on a skid. A cylindrical container is mounted on a tilt table attached to the skid such that the container is within the C-shaped frame. A telescoping ram is mounted on the frame to compact trash within the container. A foot guard is provided around the bottom of the container to prevent objects from being placed under the container when it is tilted forward.

14 Claims, 5 Drawing Figures

TRASH COMPACTOR

BACKGROUND OF THE INVENTION

The present invention relates to trash compactors. More particularly, the invention relates to industrial and commercial trash compactors.

The ecology moment has focused and continues to focus interest in several technological areas. One of these areas is the treatment and disposal of trash. This is especially true with respect to marine vessels and offshore drilling platforms. No longer is it appropriate to simply discharge the trash into the water.

One way of preliminarily treating the trash prior to ultimate disposal is compaction wherein the trash is subjected to forces which compress and distill the trash into a compact and manageable form. This conserves space until the trash can ultimately be disposed in a suitable manner.

Trash compactors have taken many forms and have been designed for both industrial and home use. Trash compactors which are used in the home, are generally lightweight units designed for light applications. Household type trash is relatively easy to compact and is generally not accumulated in large quantities. Accordingly, consumer designs have focused on units which are affordable to the consumer, which have a pleasing design, and which are sufficiently but not excessively rugged.

Commercial and industrial trash compactors are of a more heavyweight design than consumer versions. This allows them to handle greater quantities of trash and also trash which is more difficult to compact. However, this requires the application of different design parameters to handle the larger loads. Because greater quantities of trash are compacted, provisions must be made for removal of the trash from the compactor. Also, because of the greater quantities of trash and the resistance to compacting, industrial compactors must be designed with frames and power units which can handle the increased loads.

Numerous industrial designs have been proposed and built. However, these units tend to be large and cumbersome. Additionally, they make inefficient use of available space. In marine vessels and offshore drilling platforms where space is at a premium, a trash compactor which utilizes a substantial amount of space defeats the purpose of compacting the trash. Accordingly, there exists a need in the art for a commercial and industrial trash compactor which is efficient, rugged, and which utilizes minimal space. Such a device is disclosed in claimed herein.

SUMMARY OF THE INVENTION

The present invention provides a commercial and industrial size trash compactor which utilizes a unique, compact design to conserve space. Additionally, the design of the trash compactor provides for simple, efficient operation.

The trash compactor includes a rigid, generally C-shaped frame member which is mounted on a skid such that the trash compactor can be easily transported when necessary. A container unit is mounted on the skid within the generally C-shaped frame member.

The container unit includes a base, a cylindrical container, and a cover. The cover and the container are constructed such that they can easily be opened for trash insertion or removal.

In the preferred embodiment, the cylindrical container is formed from three main sections. The first section comprises about half of the cylindrical shape such that it is essentially semicircular in cross-section. The remaining two sections each form essentially one-quarter of the cylindrical container and act as doors. The quarter sections are connected to the semicircular portion by hinges such that they can be swung outwards to open the container. A latch mechanism is provided to hold the quarter sections together during normal operation and to maintain the cylindrical shape of the container.

The cover includes a generally planar top surface and a downwardly extending cylindrical flange. The lid is also divided into three main sections corresponding to the sections of the cylindrical container. The cover is positioned above the container and is slightly larger in diameter.

A hydraulic ram is mounted on the upper end of the C-shaped frame member and extends through the cover such that it can compact trash within the cylindrical container. In order to provide a low profile, the hydraulic ram includes first and second telescopically disposed plungers for advancing the ram.

In the preferred embodiment, the cylindrical container is mounted on a tilt table which is hinged to the front of the skid. The tilt table is hydraulically controlled such that the rear portion can be lifted upward thus causing the container mounted on the table to be tilted forward. This facilitates placement of garbage within the trash compactor and also facilitates removal of the compacted trash.

A flexible guard is provided on the skid around the edge of the tilt table to prevent objects from being placed under the table when it is in the raised position. The guard is designed such that it can flex outward when the quarter sections of the cylindrical container are opened.

A drive unit including a hydraulic pump and reservoir are positioned on the skid behind the C-shaped frame member. The drive unit is utilized to control the ram which compresses the trash and to tilt the table to facilitate insertion and removal of garbage.

Additional features of the invention as well as numerous advantages thereof will become more fully apparent from the drawings and following detailed description and appended claims.

DETAILED DESCRIPTION OF THE PREFERRED EMBODIMENT

Figure 1:
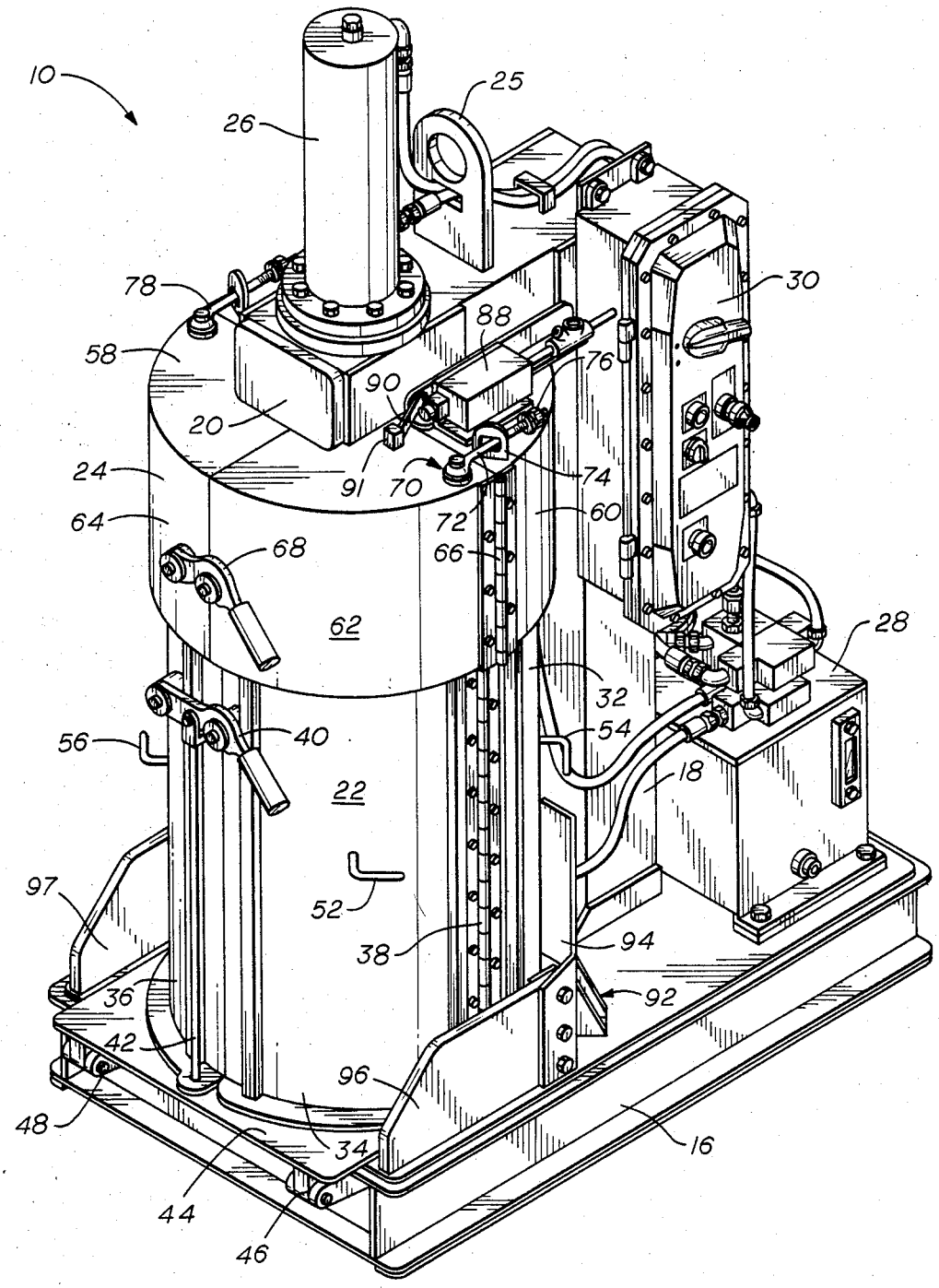
FIG. 1 is a perspective view of a preferred embodiment of the trash compactor of the present invention.

The present invention provides a heavy duty trash compactor suitable for industrial and commercial operations. FIG. 1 is a perspective view of the trash compactor 10 of the present invention. The trash compactor 10 is designed to efficiently utilize space. Accordingly, the compactor 10 is especially suitable for use on offshore drilling platforms and marine vessels where space is at a premium.

Figure 5:
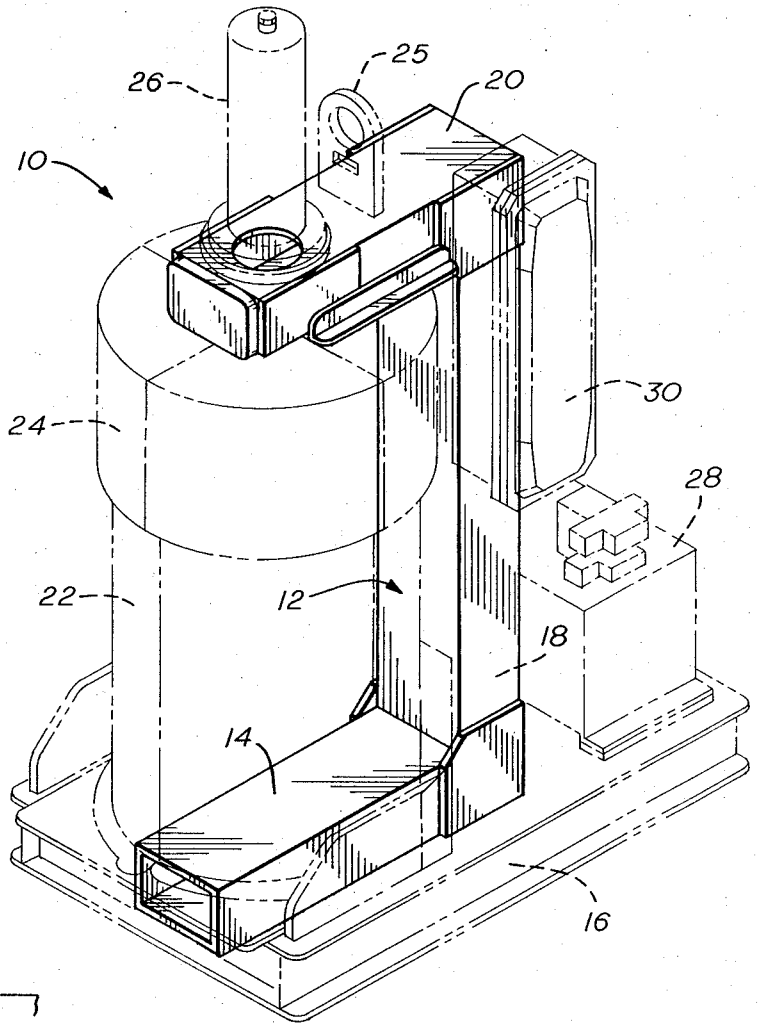
FIG. 5 illustrates the generally C-shaped frame member with the other major portions of the trash compactor shown in phantom lines.

With reference next to FIG. 5, the major components of compactor 10 are schematically illustrated. Compactor 10 includes a rigid, generally C-shaped frame 12. Frame 12 includes a lower leg 14 which is mounted within a skid 16. Frame 12 also includes an upright member 18 and a top leg 20. A cylindrical container 22 is positioned within frame 12 and is designed to hold the trash to be compacted. A cover 24 is mounted on the bottom of top leg 20 above container 22. A bracket 25 is mounted on top of frame 12 for hoisting compactor 10 so that it can be moved.

A hydraulic ram 26 is mounted on the end of top leg 20 and passes through cover 24. When ram 26 is extended, it compacts the trash contained within container 22.

A hydraulic power unit 28 is mounted on skid 16 behind frame 12. In the preferred embodiment, power unit 28 includes an electrically powered hydraulic pump and reservoir. A control box 30 is mounted on the side of upright member 18 of frame 12 from which the operation of compactor 10 is controlled.

Figure 3:
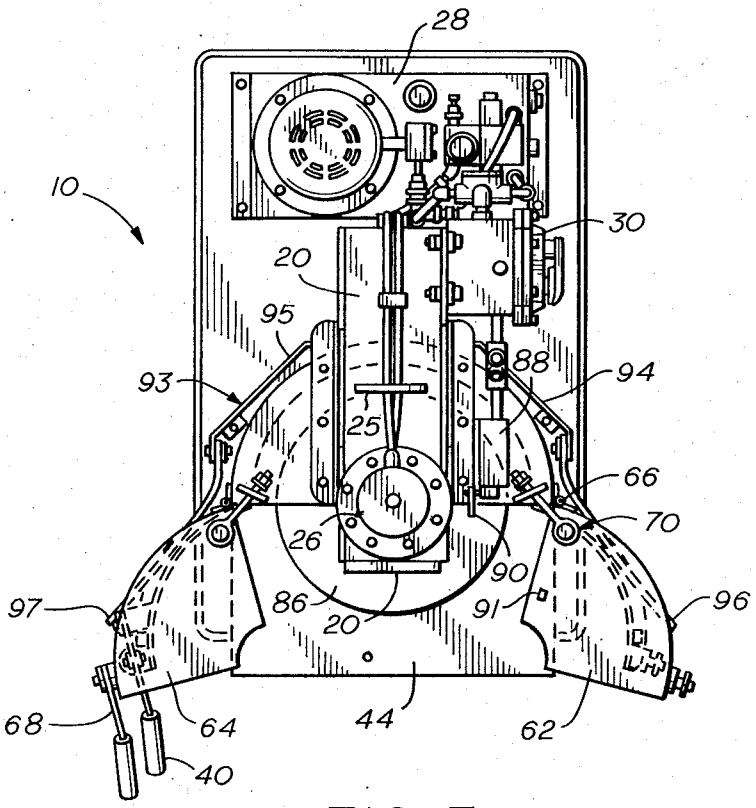
FIG. 3 is a top view of the trash compactor with the container unit and cover opened.
Figure 2:
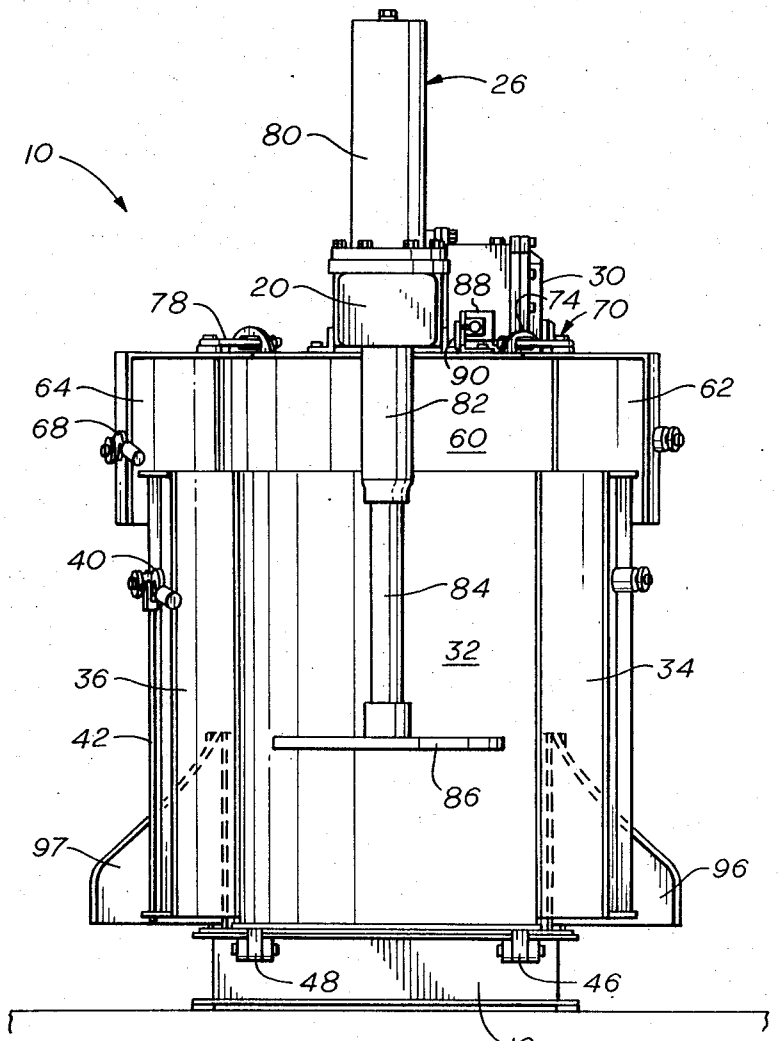
FIG. 2 is a front plan view of the trash compactor of FIG. 1 showing the cover and container unit opened and the compacting ram extended.

Referring now to FIG. 1, cylindrical container 22 is formed from three main components. The first component is a back 32 which is adjacent upright member 18 of C-shaped frame 12. Back 32 is generally semicircular in cross-section. The forward half of cylindrical container 22 is formed from first and second doors 34 and 36. Door 34 is connected to back 32 by a hinge 38. Door 36 is similarly attached by a hinge on the other side to back 32. Accordingly, doors 34 and 36 can be swung open as illustrated in FIGS. 2 and 3 to permit open access into cylindrical container 22.

Since the front of the container 22 is formed from two doors which open in opposite directions, less room is required on each side of compactor 10 to open the container. This is important in drilling platform operations where safety regulations require clear areas of passage around equipment but where space is at a premium. Additionally, since ram 26 is mounted on C-shaped frame 12 which is positioned behind container 22, the overall width of compactor 10 can be maintained at a minimum.

During operation, doors 34 and 36 are maintained in the closed position by a latch 40. A drop bar 42 is connected to latch 40 and extends down into tilt table 44 on which cylindrical container 22 stands. This provides additional support to the bottom of container 22 to prevent it from being pushed open as trash is compacted within the container.

Figure 4:
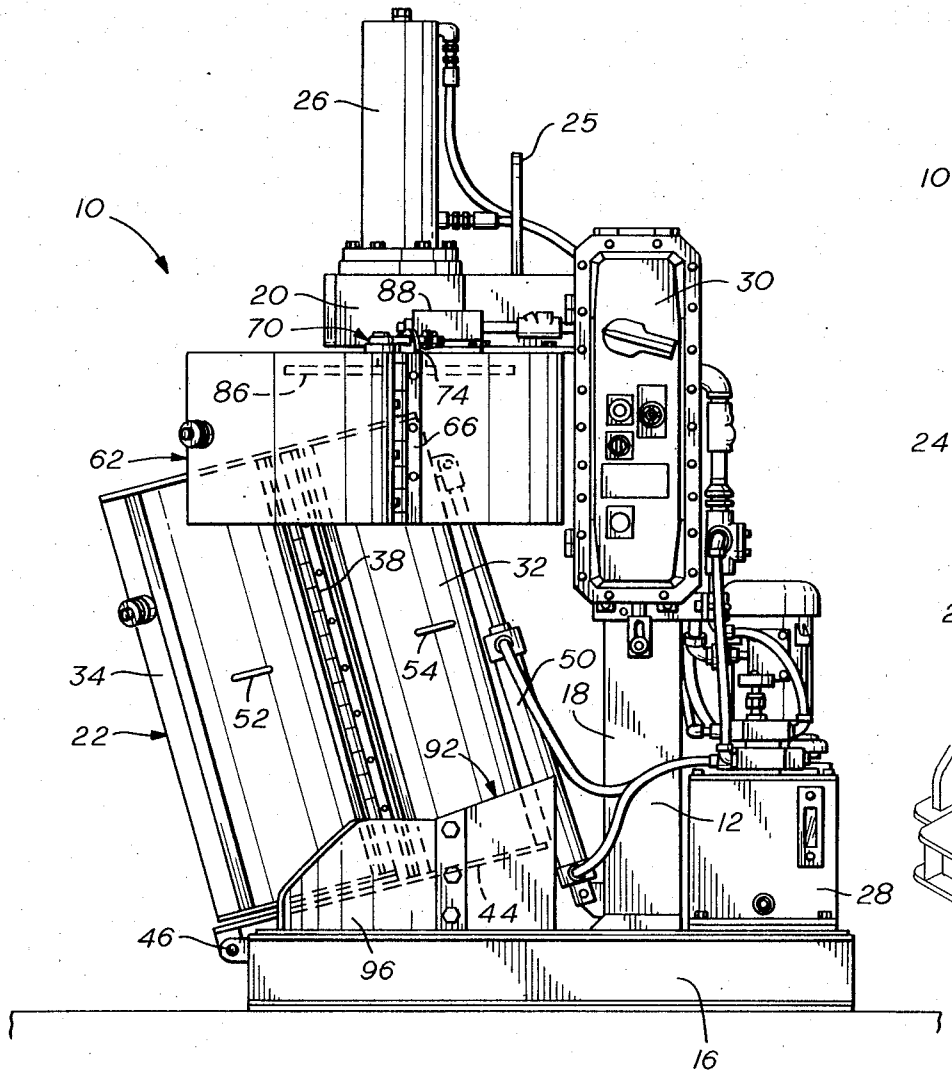
FIG. 4 is a side plan view of the trash compactor with the tilt table raised.

Tilt table 44 is connected to skid 16 by hinges 46 and 48 such that it can be tilted forward as illustrated in FIG. 4. A hydraulic cylinder 50 is connected to back 32 of cylindrical container 22 on one end and to upright member 18 of frame 12 at the other end to control the tilting of table 44. When cylindrical container 22 is tilted forward on table 44, it is easier to place trash into the container for compaction. Additionally, by tilting table 55 forward and by opening doors 34 and 36, the compacted trash can more easily be removed.

In the preferred embodiment, trash is compacted into a bag positioned within cylindrical container 22. The bag can be formed from any suitable material and preferably includes straps which extend over the top of container 22 to hold the bag open. These straps can be connected to hook 52 on door 34, hook 54 on back 32, hook 56 on door 36 (see FIG. 1) and a fourth hook also positioned on back 32. When the bag is full, the straps can be released from the hooks and it can be used to hoist the bag from compactor 10.

Referring again to FIG. 1, cover 24 includes a generally planar top 58 which is mounted on the bottom of top leg 20 of C-shaped frame member 12. A cylindrical flange extends downward from top 58 to form the sides of cover 24 which surround the top cylindrical container 22. Cover 24 is also divided into three main sections including a back 60 and first and second doors 62 and 64. Door 62 is connected by hinge 66 to back 60. A similar hinge connects door 64 to the other side of back 60. A latch 68 secures doors 62 and 64 in the closed position during operation.

A stop 70 is mounted on the top of cover 24 to limit the outward swing of door 62. stop 70 includes a rod 72 which is bolted to door 64 and extends through a bracket 74 mounted on back 60. As door 62 is opened, rod 72 slides through bracket 74 until nut 76 engages the bracket, thus limiting further movement of door 62. A similar stop 78 limits the movement of door 64 with respect to back 60.

FIGS. 2 and 3 illustrate doors 62 and 64 of cover 24 and doors 34 and 36 of container 22 in the opened position. It can readily be seen in the figures that the overall width of compactor 10 is not significantly increased when the doors are opened.

Reference is next made to FIG. 2 which illustrates in greater detail the hydraulic ram 26 which compresses the trash in compactor 10. Ram 26 includes a hydraulic cylinder 80 mounted on the end of top leg 20 of frame 12. Cylinder 80 drives a pair of dual plungers 82 and 84 which extend down through leg 20 and cover 24 into cylindrical container 22. A platen 86 is mounted on the bottom of plunger 84 for compacting the trash.

Plungers 82 and 84 are illustrated in the fully extended position in FIG. 2. In the retracted position, platen 86 is raised such that it is just slightly below top 58 of cover 24 (see FIG. 4). In the preferred embodiment compactor 10 is designed such that platen 86 is raised automatically after a compaction stroke or after any interruption of a compaction stroke.

Hydraulic ram 26 and hydraulic cylinder 50 which controls tilt table 44 are powered by a power unit 28 mounted on skid 16 behind frame member 12. Power unit 28 includes an electrically powered hydraulic pump and reservoir. Suitable units are well known in the art as are the necessary controls and fluid lines.

The operation of ram 26 and cylinder 50 are controlled by switches located on control box 30. Control box 30 is mounted on the side of frame member 12 behind cylindrical container 22.

The preferred embodiment of the present invention includes numerous safety devices to insure safe operation of compactor 10. First, a safety switch 88 is positioned on top 58 of cover 24 between back 60 and door 62. A lever 90 attached to switch 88 engages stop 91 on the door 62 when the door is closed. If switch 88 is not engaged, hydraulic ram 26 is deactivated so that it cannot move. Accordingly, if doors 62 and 64 of cover 24 are opened, the ram is inoperable. Thus, the ram cannot be accidentally engaged so as to injure a person who is loading trash into compactor 10. Additionally, when tilt table 44 is tilted forward for trash to be introduced or for removal of trash from container 22, the ram is also inoperable. This prevents any damage from occurring to compactor 10.

A second safety feature provided with the preferred embodiment of the present invention is a foot guard 92 which is mounted on skid 16 around tilt table 44. Foot guard 92 includes a stationary section 94 and a movable section 96. A first edge of movable section 96 is attached to stationary section 94 slightly behind the point which is perpendicular to hinge 38 on cylindrical container 22. Accordingly, when door 34 of container 22 is opened, it can cause movable section 96 to flex outward as illustrated in FIGS. 2 and 3 to accommodate the opening of door 34. A similar foot guard 93 is positioned on the other side of container 22 and includes stationary section 95 and movable section 97.

In one preferred embodiment, movable section 96 is formed from a resilient sheet such as heavy rubber so that it can bend outward when door 34 pushes against it but returns to its original position once the force has been removed. Movable section 96 is secured along one edge to stationary section 94. Accordingly, foot guard 92 is always substantially adjacent to the bottom of cylindrical container 22. This not only prevents objects such as an operator's foot from being placed under tilt table 44 when it is in the raised position but also conserves space. Compator 10 is designed such that the total width is only slightly larger than the width of cylindrical container 22. Thus, the present invention is especially suitable for application such as offshore drilling platforms or marine vessels where space is at a premium.

In a second preferred embodiment, movable section 96 is formed from a rigid piece of metal or plastic and is connected to stationary section 94 by a hinge or flexible piece of rubber.

All of the electrical connections of the preferred embodiment of the present invention are sealed in order to prevent the formation of sparks when the present invention is utilized around explosive materials.

As can be seen from the foregoing, the present invention provides a compact, heavy duty trash compactor. The unit is especially suitable for use in offshore drilling platforms because of its compactness and other safety features. While the present invention has been described with respect to the presently preferred embodiments, it will, of course, be appreciated that the invention may be embodied in other specific forms without departing from the spirit thereof. Accordingly, the scope of the invention is defined by the appended claims rather than by the foregoing description. All changes or modifications which come within the meaning and range of equivalency of the claims are to be embraced within their scope.

I claim:

1. A compact, heavy duty trash compactor comprising:

a skid;

a rigid, generally C-shaped frame member, a lower leg of said member being mounted within said skid;

a container unit mounted on said skid within said C-shaped frame;

a hydraulic ram mounted on an upper end of said C-shaped frame member for compacting trash within said container;

a hydraulic drive unit;

a tilt table beneath said container unit, said tilt table being hinged to said skid such that it can tilt said container unit forward; and a hydraulic cylinder mounted to said container unit for tilting said container unit forward on said tilt table.

2. A compact, heavy duty trash compactor as defined in claim 1 further comprising a cover mounted on said C-shaped frame above said container.

3. A compact, heavey duty trash compactor as defined in claim 1 wherein said container unit is substantially cylindrical in shape having a back portion comprising essentially half of said cylindrical container, and first and second doors forming essentially the other half of said cylindrical container, said doors being hinged to said back.

4. A compact, heavy duty trash compactor as defined in claim 1 further comprising a foot guard mounted on said skid around the bottom of said container unit, said foot guard having a first, stationary section and a second, movable section.

5. A compact, heavy duty trash compactor as defined in claim 4 wherein said movable section comprises a resilient sheet secured along a first edge to said stationary section.

6. A compact, heavy duty trash compactor comprising:

a skid having a substantially planar upper surface;

a generally C-shaped frame member, a lower leg of said member being mounted within said skid; and a generally cylindrical container unit mounted on said skid within said C-shaped frame member, said container comprising a back portion forming essentially half of said cylindrical container and first and second doors forming essentially the other half of said cylindrical container, said doors being hinged to said back;

a hydraulic ram mounted on an upper end of said C-shaped frame member for compacting trash within said container, said ram including telescopic plungers and a platen; and a hydraulic drive unit for powering said hydraulic ram.

7. A compact, heavy duty trash compactor as defined in claim 6 further comprising a cover mounted on said C-shaped frame member above said cylindrical container, said cover having a back portion and first and second doors generally corresponding to the back portion and doors of said cylindrical container.

8. A compact, heavy duty trash compactor as defined in claim 7 wherein said cover comprises a generally planar top and a cylindrical flange extending downward from said top to form the sides of said cover.

9. A compact, heavy duty trash compactor as defined in claim 8 further comprising a tilt table beneath said cylindrical container unit, said tilt table being hinged to said skid such that it can tilt said cylindrical container forward.

10. A compact, heavy duty trash compactor as defined in claim 9 further comprising a hydraulic cylinder mounted to said cylindrical container and said C-shaped frame member for tilting said container unit forward on said tilt table.

11. A compact, heavy duty trash compactor as defined in claim 10 further comprising a foot guard mounted on said skid around the bottom of said cylindrical container unit, said foot guard having a first, stationary section and a second, movable section.

12. A compact, heavy duty trash compactor as defined in claim 11 wherein said movable section comprises a resilient sheet secured along a first edge to said stationary section.

13. A compact, heavy duty trash compactor comprising;

a skid having a substantially planar upper surface;

a rigid, generally C-shaped frame member mounted on said skid, said frame member including a lower leg, an upright member and a top leg, said lower leg being mounted within said skid;

a generally cylindrical container unit mounted on said skid within said C-shaped frame member, said container comprising a back portion forming essentially half of said cylindrical container and first and second doors forming essentially the other half of said cylindrical container, said doors being hinged to said back;

a tilt table mounted to the bottom of said cylindrical container, said tilt table being hinged to said skid such that it can tilt said cylindrical container forward;

a hydraulic cylinder mounted between said cylindrical container and said C-shaped frame member for tilting said cylindrical container and said tilt table forward;

a cover mounted on said top leg of said C-shaped frame member above said cylindrical container, said cover comprising a generally planar top and a cylindrical flange extending downward from said top to form the sides of said cover, said cover having a back portion and first and second doors generally corresponding to the back portion and doors of said cylindrical container;

a hydraulic ram mounted on an end of said top leg for compacting trash within said cylindrical container, said ram including telescopic plungers and a platen; and a hydraulic drive unit for powering said hydraulic ram and said hydraulic cylinder.

14. A compact, heavy duty trash compactor as defined in claim 13 further comprising a foot guard mounted on said skid around the bottom of said cylindrical container, said foot guard having a first, stationary section and a second movable section.

* * * * *